United States Patent [19]

Colli et al.

[11] Patent Number: 4,969,608

[45] Date of Patent: Nov. 13, 1990

[54] DEVICE FOR REGULATING THE YARN WINDING SPEED IN THE FORMATION OF CONICAL BOBBINS IN A ROTOR SPINNING MACHINE

[75] Inventors: Luigi Colli; Francesco Ferro, both of Pordenone; Sergio Montali, Roveredo in Piano, all of Italy

[73] Assignee: Savio S.p.A., Pordenone, Italy

[21] Appl. No.: 375,693

[22] Filed: Jul. 5, 1989

[30] Foreign Application Priority Data

Jul. 15, 1988 [IT] Italy ..... 21380 A/88

[51] Int. Cl.[5] ..... B65H 54/10; B65H 54/42; B65H 59/38

[52] U.S. Cl. ..... 242/18 DD; 242/45

[58] Field of Search ..... 242/18 DD, 18 R, 18 CS, 242/45

[56] References Cited

U.S. PATENT DOCUMENTS 3,860,186 1/1975 Schiltknecht et al. ... 242/18 DD X
3,945,579 3/1976 Schippers et al. ..... 242/18 DD
4,789,107 12/1988 Hauser et al. ..... 242/18 DD X

*Primary Examiner*—Stanley N. Gilreath
*Attorney, Agent, or Firm*—Hedman, Gibson, Costigan & Hoare

[57] ABSTRACT

This invention relates to a device for regulating the winding speed in the formation of cross-wound conical bobbins where the yarn is withdrawn at constant speed from a rotor spinning unit by a lever system able to displace the friction drive band of the drive roller for the conical bobbin under formation, in order to vary the average resultant value of the varying winding speed during each double stroke of the yarn guide element. Said lever system is operated by a two-direction rotary drive source which is activated when a linear position element, associated rigidly with the yarn storage element, senses by known means that abnormal storage swings persist.

9 Claims, 1 Drawing Sheet

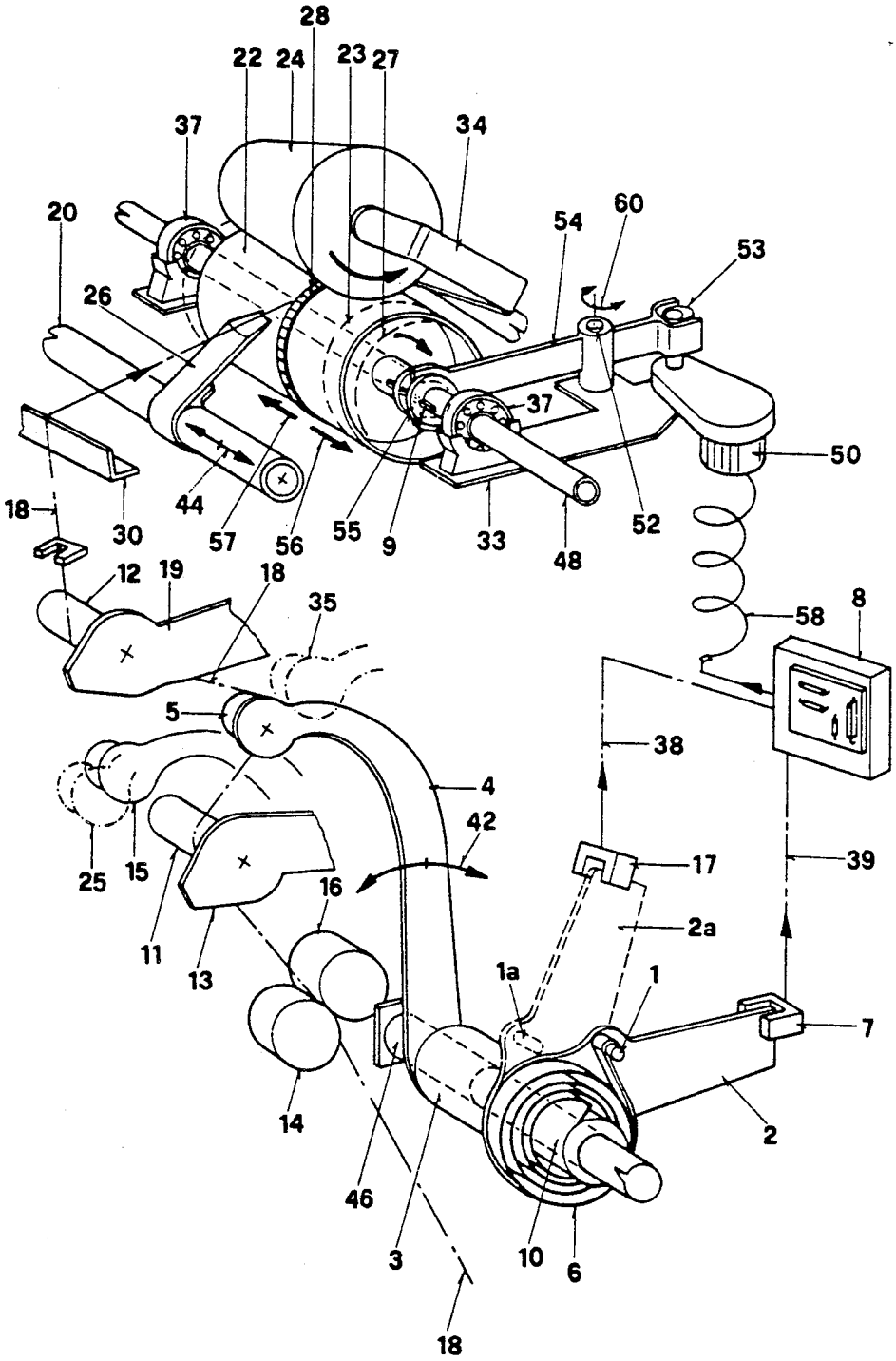
28
22
24
23
27
37
34
20
60
54
53
26
37
50
18
44
30
57
56
55
9
33
48
52
12
19
18
35
58
8
5
38
4
42
25
15
16
17
39
2a
11
13
1a
1
7
14
2
46
3
10
6
18

DEVICE FOR REGULATING THE YARN WINDING SPEED IN THE FORMATION OF CONICAL BOBBINS IN A ROTOR SPINNING MACHINE

The invention relates to a device able to regulate the average winding speed in the formation of conical bobbins in a rotor spinning machine so that the swing of a yarn storage element extends within a preset predetermined range.

More particularly the invention relates to a device having a lever system able to displace a friction drive band of the drive roller so as to regulate the intermittent storage and return swing of the yarn storage element should the yarn leave the preset predetermined position range.

In rotor spinning units the yarn emerges from the exit of a extractor rollers at constant speed and, in forming a frusto-conical package, must be deposited at a speed which varies between the major diameter and minor diameter of said package.

In such an operational process it is therefore necessary to periodically vary the yarn length contained in the section between the extractor rollers and the point at which it is deposited on the circumference of the conical bobbin. This length variation and the consequent variation in yarn tension are compensated by adjusting the yarn path by means of a winding tension regulator and compensator device.

Yarn storage elements which compensate for the variation in the yarn winding speed on a frusto-conical surface are known in the art. They largely comprise a deflecting roller connected to a rocker arm. The swing position of this latter, which keeps a roller connected to it constantly bearing against the yarn, represents the amount of stored yarn, which is either increasing or decreasing depending on the stage in the progress of the entire yarn storage and return cycle.

Any slippage between the drive roller and the bobbin under formation, which is frequently present due to the friction drive used, increases the length of yarn stored and changes the swing position of the mobile arm, which then moves outside its normal swing range and in the limit abuts against a stop, consequently nullifying the tension of the yarn being collected. Thus without tension, the yarn leaving the extraction rollers winds with irregular turns, so prejudicing the bobbin formation and in the limit twisting about itself to create loops and tangles such as to compromise the yarn consistency. In addition, the tangled yarn frequently creates obstacles such as to interrupt yarn continuity, so halting the spinning process.

The high yarn formation rate means that any production hold-ups in a rotor spinning unit assume considerable importance because of the reduced rate of yarn collection on the bobbins.

Elements and devices for intermittent yarn storage and return which undergo automatic adjustment when the aforesaid difficulties occur are also known. By way of example some known devices are described and claimed in Italian patent No. 1,203,383 and the U.S. patent application No. 169,322, now U.S. Pat. No. 4,854,512, and other applications by the present applicant. Although said devices have certain operational merits they could well be improved by the application of certain expedients relating to the automatic adjustment of the extent of the yarn storage swing.

Specifically, the device for regulating the winding speed in the formation of conical bobbins according to the present invention is characterised by comprising a lever system able to displace a friction drive band of the drive roller for the conical bobbin under formation, in order to vary the average resultant value of the varying winding speed during each double stroke of the yarn guide element.

Said lever system is operated by a two-direction rotary drive source which is activated when a linear position element, associated rigidly with the yarn storage element, senses by known means that abnormal storage swings persist.

According to one embodiment, the device is present individually in each yarn winding position in the formation of cross-wound conical bobbins.

By way of non-limiting example a description is given hereinafter of the device, shown diagrammatically on the single accompanying drawing, together with clarification of further details and characteristics, in which respect it is to be understood than any changes in the relative positions of the elements and any simplifications deriving therefrom are to be considered as falling within the requested protection by representing constructional modifications included within the general idea.

The accompanying drawing shows a diagrammatic isometric view of the regulator device for the yarn winding speed in the formation of cross-wound conical bobbins of the present invention, cooperating with the intermittent yarn storage and return element and with the yarn guide element, and also shows the presence of the bobbin under formation driven by the friction band of the drive roller.

In the single FIGURE: 1 is the connection pin of the outer loop of the spiral elastic element 6. Said pin 1 is rigidly fixed in an integral manner to the mobile arm 2; 1*a* is the position which the pin 1 assumes in its swing movement; 2 is the mobile arm of the yarn compensation and return lever system, which operates as the linear position element of a system for controlling and monitoring the storage; 2*a* is the position which the mobile arm 2 assumes at that moment during its swing movement when the length of the stored yarn 18 is a normal minimum; 3 is the bush which rigidly joins together the two mobile arms 2 and 4; 4 is that mobile arm of the yarn compensation and return lever system which operates as the actual storage and return element for the yarn 18 while also acting as the tension compensation and adjustment element for the yarn 18 being wound; 5 is a mobile deflecting and guide roller rigid with the end of the mobile arm 4 but able to rotate about itself so as not to generate grazing friction against the yarn 18 undergoing continuous collection; 15 is the position which the mobile deflecting and guide roller assumes at the moment during its swing movement when the length of the stored yarn 18 is a normal minimum; 25 is a non-normal position which the mobile deflecting and guide roller 5 could assume during its swing movement by virtue of being outside the lower limit 15 of the predetermined normal storage range; 35 is a non-normal position which the mobile deflecting and guide roller 5 could assume during its swing movement by virtue of being outside the upper limit 15 of the predetermined normal storage range; 6 is the spiral elastic element which stores elastic energy by the tensioning of the yarn. Said element 6 consists of a steel strip or wire or similar steel shapes, wound substantially as a flat Archimedes spiral; 7 and 17 are two position transducers of optical, magnetic, analog or digital type. Said transducers convert the position of the end of the mobile arm 2 into an electrical signal or a series of electrical signals; 8 is a central unit which combines an electrical comparator with a central electronic microprocessor unit, both of known type. Said central unit processes the data originating from the transducers 7 and 17, to then activate a two-direction rotary drive source 50 when regularizing the storage of yarn 18; 10 is a shaft which in proximity to one of its ends is fixed to the inner end of the spiral elastic element 6; 11 and 12 are fixed yarn deflecting and guide rollers having a substantially cylindrical profile and connected rigidly to the base plates 13 and 19. These latter are fixed to the machine structure, not shown on the FIGURE; 14 and 16 are a pair of extractor rollers positioned along the path of the yarn 18, both rollers being pressed against each other with said yarn 18 passing between them to withdraw it at constant speed from a spinning unit of a rotor spinning machine; 18 is the collected yarn subjected to storage and return at the outlet of the pair of extractor rollers 14 and 16; 20 is a solid or hollow shaft of substantially circular cross-section which is operated as a control rod for the yarn guide elements 26 by means of a suitably shaped cam so as to transmit a movement of suitable kinematic and dynamic characteristics to said yarn guide elements 26; 22 is the drive roller for rotating the conical bobbin 24 under formation; 24 is the cross-wound yarn bobbin under formation; 26 is the yarn guide element driven with reciprocating to-and-fro motion by the shaft 20, this latter extending along the entire operational winding face; 28 is the friction contact region in the form of a narrow circular band, projecting slightly from the surface of the drive roller 22. By means of this projection it drives the conical bobbin 24; 30 is a blade for deflecting the path of the yarn 18; 34 is the bobbin carrier arm which supports the yarn bobbin 24; 38 and 39 are the cables connecting the transducers 7 and 17 to the central unit 8; 42 indicates the swing path of the mobile arm 4; 44 indicates the reciprocating to-and-fro movement path of the shaft 20; 46 is the pivot about which the intermittent yarn storage and return lever system swings by way of the bush coupling 3; 48 is the drive shaft which extends along the entire winding face, supported in bearings 37; 50 is the two-direction rotary drive source consisting preferably of a stepping motor which by way of a lever system displaces the drive roller 22 and consequently the drive band 28 in one direction or the other in order to vary the line of effective contact to consequently obtain a controlled variation in the average winding speed of the yarn 18; 52 is the pivot about which the lever 54 rotates by virtue of the rotary movement of the drive source 50; 33 is the support for the lever system which displaces the drive roller 22; 53 is the cam keyed onto the output shaft of the drive source 50. The rotation of said cam determines the angular displacement 60 of the lever 54, rotatably mounted on the pivot 52, and consequently the axial displacement of the drive band 28 by means of the flanges 55; 9 is the key which enables the drive roller 22 to slide axially, rigid with the flanges 55. Between these latter there engages a forked end of the lever 54; 56 and 57 are arrows indicating the axial displacements of the drive roller 22, the edge of one end of which varies in position between the lines 27 and 23; 58 is the cable connecting the central unit 8 to the drive source 50. The operation of the device according to the invention is as follows.

The average winding speed corresponds substantially to the spinning speed of the rotor spinning chamber. When the yarn 18 is being collected on the minor diameter of the bobbin 24 the winding speed is less than the speed at which it is fed by the extractor rollers 14 and 16, and the storing lever system by means of its mobile arm 4 stores a suitable length of yarn 18.

This stored length is returned gradually as the collection speed increases due to the yarn being moved towards the major diameter of the bobbin 24 by means of the yarn guide element 26. The ratio of the minor diameter to the major diameter of the bobbin 24 under formation determines the maximum length of yarn which has to be stored and then returned for each complete cycle of the yarn guide element 26.

Because of the rigid connection between the two mobile arms 2 and 4, the variation in the position of the mobile deflecting roller 5 also varies the position of the end of the lever 2. Said end interacts with the linear position transducers 7 and 17 without the need for mutual contact, these latter generating at their output a signal or several signals of electrical nature which are fed through the connection cables 38 and 39 to the central unit 8 which compares and processes said signals. If during the continuous winding process the storage swing remains within the predetermined limits preset by the position of the two transducers, the central unit 8 confirms that the storage and return cycles of the yarn 18 are normal. Thus no signal is generated at the output of the central unit 8 and no activation signal is therefore fed to the drive source 50. If during the continuous winding process the storage swing strays outside the predetermined preset limits, the corresponding mobile linear position of the end of the arm 2 would move beyond transducers 7 and 17. This causes the transducers 7 and 17 to generate an electrical signal or signals which after suitable comparison and processing in the central unit 8 give instant rise to an instantaneous output signal which activates the drive source 50. Said two-direction rotary drive source having received the activation signal rotates the cam 53 which angularly displaces the corresponding lever pivoted on the pivot 52. By means of its mechanical thrust against the flanges 55, the forked end of the lever 54 causes the drive roller 22 and thus its drive band 28 to undergo an axial displacement in one direction or the other, so changing the diameter of effective contact between the conical bobbin 24 and the drive roller 22. The winding speed of the yarn 18 thus undergoes suitable variation, which returns the storage swing to within the range of values corresponding to normal storage.

This latter operation can be further clarified as follows. If the mobile deflecting roller 5 deflects the yarn 18 to a position 35 which exceeds the maximum preset storage limit, the position of the mobile arm 2 is such as to cause the transducer 7 to generate an output signal corresponding to said position.

Said electrical output signal is fed to the central unit 8 via the connection cable 39. The central unit 8 having identified the type of electrical signal arriving from the transducer correspondingly produces a specific output command signal which via the connection cable 58 activates the two-direction rotary drive source 50. Said drive source operates the cam 53 and the lever 54 to axially displace the drive roller 22 in the direction indicated by the arrow 57. Consequently, the drive band 28 operates on decreasing diameters of the conical winding surface, ie it is displaced and positioned in the direction of the minor base of the conical bobbin 24.

The average winding speed consequently increases, ie it assumes an average value slightly higher than the previous average value, so leading to rapid and progressive take-up of the excessive stored yarn, which will have arisen due to a multiplicity of factors in play. Said average value of the yarn winding speed is the average value of the entire instantaneous differing winding speeds during one complete double-storke cycle of the yarn guide element 26. When the drive band 28 of the drive roller 22 moves in the direction 57 towards the minor diameter of the conical bobbin 24, the average winding speed of this latter increases because its r.p.m. increases. The drive roller 22 is rotated at constant r.p.m. by the drive shaft 48 extending along the entire winding face.

If the mobile deflecting roller 5 deflects the yarn 18 to a position 25 outside the minimum preset storage limit 15, the position of the mobile arm 2 is such as to cause the transducer 17 to generate an output signal corresponding to said position. Said electrical output signal from the transducer 17 is fed to the central unit 8 via the connection cable 38.

The central unit 8 having identified the type of electrical signal arriving from the transducer correspondingly produces a specific output command signal which via the connection cable 58 activates the two-direction rotary drive source 50. Said drive source operates the cam 53 and the lever 54 to axially displace the drive roller 22 in the direction indicated by the arrow 56.

Consequently, the drive band 28 operates on increasing diameters of the conical winding surface, ie it is displaced and positioned in the direction of the major base of the conical bobbin 24. The average winding speed consequently decreases, ie it assumes an average value slightly lower than the previous average value, so leading to rapid and progressive storage of yarn in the form of a loop of increasing size, and the intermittent swing of the mobile flat element 4 again falls within the limits 5 and 15 of the preset predetermined normal range. The width of the normal range is determined by the geometrical characteristics of the winding under way and the characteristics of the yarn 18 and of the conical bobbin 24 under formation.

In this latter operating situation, when the drive band 28 of the drive roller 22 moves in the direction 56 towards the major diameter of the conical bobbin 24, the average winding speed of this latter decreases because its r.p.m. decreases.

The layer of yarn 18 present on the conical tube on which the yarn is wound is sufficiently soft and deformable to enable the diameter of contact to change gradually, in line with the gradual operation of the stepping drive source 50.

A preferred embodiment has been described.

It is however apparent that other constructional arrangements falling within the spirit and range of the present invention are possible.

For example, the operating lever systems can be of different position; different drive arrangements can be provided; it is also possible to vary and modify the drive source and the lever system which axially displaces the drive roller 22; the drive source can be replaced by pneumatic or electropneumatic actuators or similar actuators able to act directly on the drive roller 22 rather than by way of levers or mechanical elements.

Furthermore, all details or constructional elements can be replaced by other technically equivalent elements; all without leaving the scope of the inventive idea as claimed hereinafter.

We claim:

1. A yarn storage and return device for winding yarn from a rotor spinning unit to a conical bobbin driven by a drive roller having a friction drive band wherein the yarn is withdrawn in a path from the rotor spinning unit at a constant speed and is guided on the bobbin by a yarn guide element which reciprocates along the axis of rotation of the bobbin, said device comprising:

(a) a yarn storage and return means which swings about an axis to change the path of the yarn for controlling and maintaining the effective length of yarn stored during the bobbin formation;

(b) a linear positioning means rigidly connected to said yarn storage and return means for controlling the position of said yarn storage and return means;

(c) a first transducer and a second transducer responsive to a first predetermined position and a second predetermined position, respectively of said linear positioning means for converting the position of said storage and return means into control signals for indicating a predetermined range of swing of said storage and control means;

(d) a control means for sensing said control signals from said first and second transducers and for generating an activating signal when said storage and return means is outside said predetermined range;

(e) a lever system including a shaft having a first end, a second end, and a pivot therebetween, said shaft being operatively connected to the drive roller at said first end for displacing the drive roller along its axis of rotation relative to the axis of rotation of the bobbin; and (f) a drive source having a cam, wherein said cam is operatively connected to said second end of said shaft, wherein when said drive source receives said activating signal from said control means, said drive source rotates said cam which pivots said shaft thereby displacing the friction band of the drive roller along the axis of rotation of the bobbin to vary the winding speed of the bobbin so that said yarn storage and return means swings within said predetermined range during each reciprocating stroke of the yarn guide element.

2. The drive of claim 1 wherein said lever system displaces the friction drive band of the drive roller along the axis of rotation of the bobbin to vary the winding speed of the bobbin during two reciprocating swings of the yarn guide element.

3. A yarn storage and return device for winding yarn from a rotor spinning unit to a conical bobbin driven by a drive roller having a friction drive band, wherein the yarn is withdrawn in a path from the rotor spinning unit at constant speed, comprising:

(a) a yarn storage end return means which swings about an axis to change the path of the yarn for controlling and maintaining the effective length of yarn stored during the bobbin formation;

(b) a transducer responsive to a predetermined range of position of said yarn storage and return means for generating a control signal when said position of said yarn storage and return means is outside said predetermined range;

(c) a control means for sensing said control signal from said transducer and for generating an activating signal when said yarn storage and return means is outside said predetermined range; and (d) a lever system driven by a drive source which is responsive to said activation signal, wherein said lever system displaces the friction drive band of the drive roller to vary the winding speed of the conical bobbin so that said yarn storage and return means swings within said predetermined range.

4. A yarn storage and return device for winding yarn from a rotor spinning unit to a conical bobbin driven by a drive roller having a friction drive band, wherein the yarn is withdrawn in a path from the rotor spinning unit at a constant speed and is guided on the bobbin by a yarn guide element which reciprocates along the axis of rotation of the bobbin, said device comprising:

(a) a first lever system including a shaft, an elastic element, and a pair of arms, which are connected to and move with each other, through which said shaft passes, and which can swing around the axis defined by said shaft, wherein said pair of arms include a first arm acting as a yarn storage and return means and a tension compensator and a regulator for the wound yarn, and a second arm acting as a linear positioning means for controlling and maintaining the effective length of the yarn stored by said first arm during the entire bobbin formation;

(b) a first transducer and a second transducer responsive to a first predetermined position and a second predetermined position respectively of said second arm for converting the position of said first storage and return arm into control signals for indicating a predetermined range of swing of said first storage and return arm;

(c) a control means for sensing said control signals from said first and second transducers and for generating an activating signal when said first storage and return arm is outside said predetermined range of swing;

(d) a second lever system including a shaft having a first end, a second end, and a pivot therebetween, said shaft being operatively connected to the drive roller at said first end for displacing the drive roller along its axis of rotation relative to the axis of rotation of the bobbin; and (e) a drive source having a cam, wherein said cam is operatively connected to said second end of said shaft of said second lever system, wherein when said drive source receives said activating signal from said control means, said drive source rotates said cam which pivots said shaft thereby displacing the friction band of the drive roller to vary the winding speed of the bobbin so that said yarn storage and return means swings within said predetermined range.

5. The device of claim 3 wherein said device further comprises a yarn guide element which reciprocates along the axis of rotation of the bobbin.

6. The device of claim 4 wherein said second lever system displaces the friction drive band of the drive roller during each reciprocating stroke of the yarn guide element.

7. The device of claim 5 wherein said lever system displaces the friction drive band of the drive roller during each reciprocating stroke of said yarn guide element.

8. The device of claim 4 wherein said second lever system displaces the friction drive band of the drive roller during two reciprocating strokes of the yarn guide element.

9. The device of claim 5 wherein said lever system displaces the friction drive band of the drive roller during two reciprocating strokes of said yarn guide element.

* * * * *